US006441283B1

(12) United States Patent
Scott

(10) Patent No.: US 6,441,283 B1
(45) Date of Patent: Aug. 27, 2002

(54) SUPPORT FOR ROUND BACK STRINGED INSTRUMENT

(76) Inventor: Thomas Scott, 160 Rattlesnake Gutter Rd., Leverett, MA (US) 01054

( * ) Notice: Subject to any disclaimer, the term of this patent is extended or adjusted under 35 U.S.C. 154(b) by 0 days.

(21) Appl. No.: 09/513,896

(22) Filed: Feb. 28, 2000

(51) Int. Cl.[7] ..... G10D 3/00
(52) U.S. Cl. ..... 84/327; 821/453
(58) Field of Search ..... 84/327, 453, 279, 84/280

(56) References Cited

U.S. PATENT DOCUMENTS

| | | | | | |
|---|---|---|---|---|---|
| 2,510,799 | A | * | 6/1950 | Carley | 84/327 |
| 3,251,258 | A | * | 5/1966 | Parker | 84/453 |
| 3,309,954 | A | * | 3/1967 | Phillips et al. | 84/453 |
| 3,323,698 | A | | 6/1967 | Sottile | |
| 3,894,464 | A | | 7/1975 | Brooks | |
| 3,979,993 | A | | 9/1976 | Proctor | |
| 4,014,240 | A | | 3/1977 | Pullen | |
| 4,188,851 | A | | 2/1980 | Wolf | |
| 4,251,016 | A | | 2/1981 | O'Rafferty | |
| 4,254,901 | A | | 3/1981 | McIntosh | |
| 4,310,111 | A | | 1/1982 | Brent | |
| 4,656,917 | A | | 4/1987 | VanHalen | |
| 4,785,705 | A | | 11/1988 | Patterson | |
| 5,069,103 | A | | 12/1991 | Healy | |
| 5,103,709 | A | * | 4/1992 | Foss, Jr. | 84/327 |
| 5,191,160 | A | | 3/1993 | Barnett | |
| 5,388,492 | A | | 2/1995 | Olson | |
| 5,616,874 | A | | 4/1997 | Krauss | |
| 5,817,961 | A | | 10/1998 | Beck | |

* cited by examiner

*Primary Examiner*—Shih-Yung Hsieh

(57) ABSTRACT

A folded sheet of rigid material to be attached to the back of a round backed stringed instrument so configured that the surface of the support against the performer's body will be parallel to the front surface of the round backed stringed instrument, this support to be attached to the stringed instruments at a plurality of attachment points by means of U-shaped protrusions bearing flexible, knitted attachment surfaces. This device provides the following new capabilities: improved instrument stability, improved instrument positionability. The performer benefits from the standpoint of health by the fact that the device dampens the twisting moment of the instrument when played, thereby reducing the fatigue in the non-strumming hand, permitting player a greater fluency of technique and increased endurance for long performances.

1 Claim, 3 Drawing Sheets

SUPPORT FOR ROUND BACK STRINGED INSTRUMENT

CROSS-REFERENCE TO RELATED APPLICATIONS

Not Applicable

STATEMENT REGARDING FEDERAL SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains to the field of stringed musical instruments. More particularly, it pertains to stringed instruments of the type held in front of the performer while being played, play affected by the plucking of the strings. More specifically, the invention is a device for supporting a round-backed stringed instrument in playing position while standing or seated.

2. Description of Prior Art

Stringed instruments, such as banjoes, ukuleles, mandolins, guitars, and the like, are played while the performer is standing and holding the instrument in front of their body, or seated and holding the instrument in front of their chest or above or resting on their thighs. For most of these instruments, just positioning and holding the instrument in front of the body during play is sufficient throughout the performance. However, guitars which have rounded backs and other round-back instruments are somewhat singular in that the performer wishing to increase the volume and the intensity of the music must pluck or stroke the strings with great intensity. A round-backed instrument, when plucked intensely, will twist from its original position. With a round-backed instrument, the only resistance to the twisting is the grip of the holding hand. The twisting moment is created by the pressure and intensity of the plucking or strumming hand. With long performances, often lasting up to several hours, holding a guitar in a playable position while playing with great intensity is extremely tiring and can cause sufficient fatigue in the performer's arms and hands as to reduce the performer's artistic ability and speed.

Prior art has attempted to provide support devices for relieving arm strength from the performer by supporting the guitar or other stringed instruments through the use of straps, levers, belts, etc. U.S. Pat. Nos. 2,510,799; 3,323,698; 3,894,464; 4,014,240; 4,188,851; 4,251,016; 4,254,901; 4,656,917; 4,785,705; 5,069,103; 5,191,160; 5,388,492; and 5,817,961 are examples of prior art attempts to provide support of the stringed instrument for the performer. Most of these prior art devices utilize straps that are passed over the shoulders, around the waist, around the neck, or otherwise across the torso and terminate in clasps that may be attached to the stringed instrument to support it in front of the performer. These all share one common disadvantage. They require additional attachments to the performer's body and are, therefore, restricting. There are few supports attached to the instrument which enable the performer to sustain the instrument in correct performing position without any attachment or encumbrance to the performer's body. One "L" guitar support (U.S. Pat. No. 5,388,492) is a support attached wholly to the instrument in question. However, such a support merely prevents the instrument from sliding down off the seated performer's lap and does not address the problem of the twisting of a round-backed stringed instrument when played with intensity.

Accordingly, there is still a need in the industry for a support for a round-backed stringed instrument which would allow the performer to play with great intensity without having to resist the twisting of the instrument solely with the non-strumming hand.

BRIEF SUMMARY OF THE INVENTION

The "Support for Round-Back Stringed Instrument" is a form consisting of two planes joined along a fold attached at a plurality of points to a round-backed stringed instrument in such a fashion that the plane of the support closest to the performer's body is parallel to the front plane of the instrument. As a result of the application of the support for round-backed stringed instruments, the surface in contact with the performer's body is flat rather than rounded. Consequently, when intense playing creates a twisting force on the instrument played, this is resisted by the flat surface of the support against the performer's body. The support for roundback stringed instrument attaches at a plurality of points to the back of the instrument and supports the instrument in a fashion that resists twisting in both a sitting or a standing position.

The object of the invention is to enhance the playing comfort for the performer of playing a round-backed stringed instrument.

DETAILED DESCRIPTION OF THE INVENTION

Figure 1:
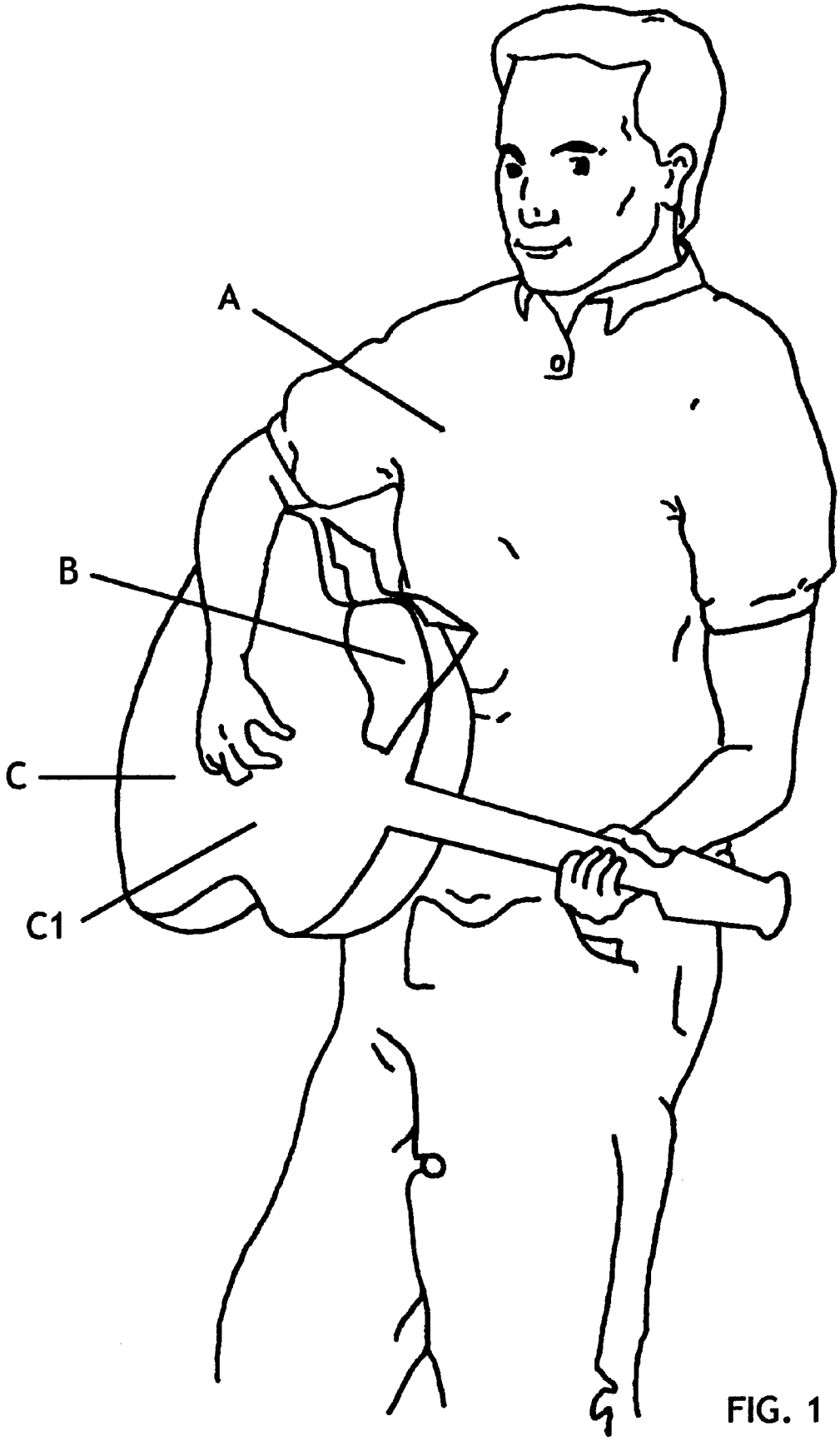
FIG. 1 illustrates a performer A holding a round-backed stringed instrument C with the apparatus B in position against the performer's torso and attached to the instrument in such a way as to resist the twisting moment of the instrument when played with great intensity.
Figure 2:
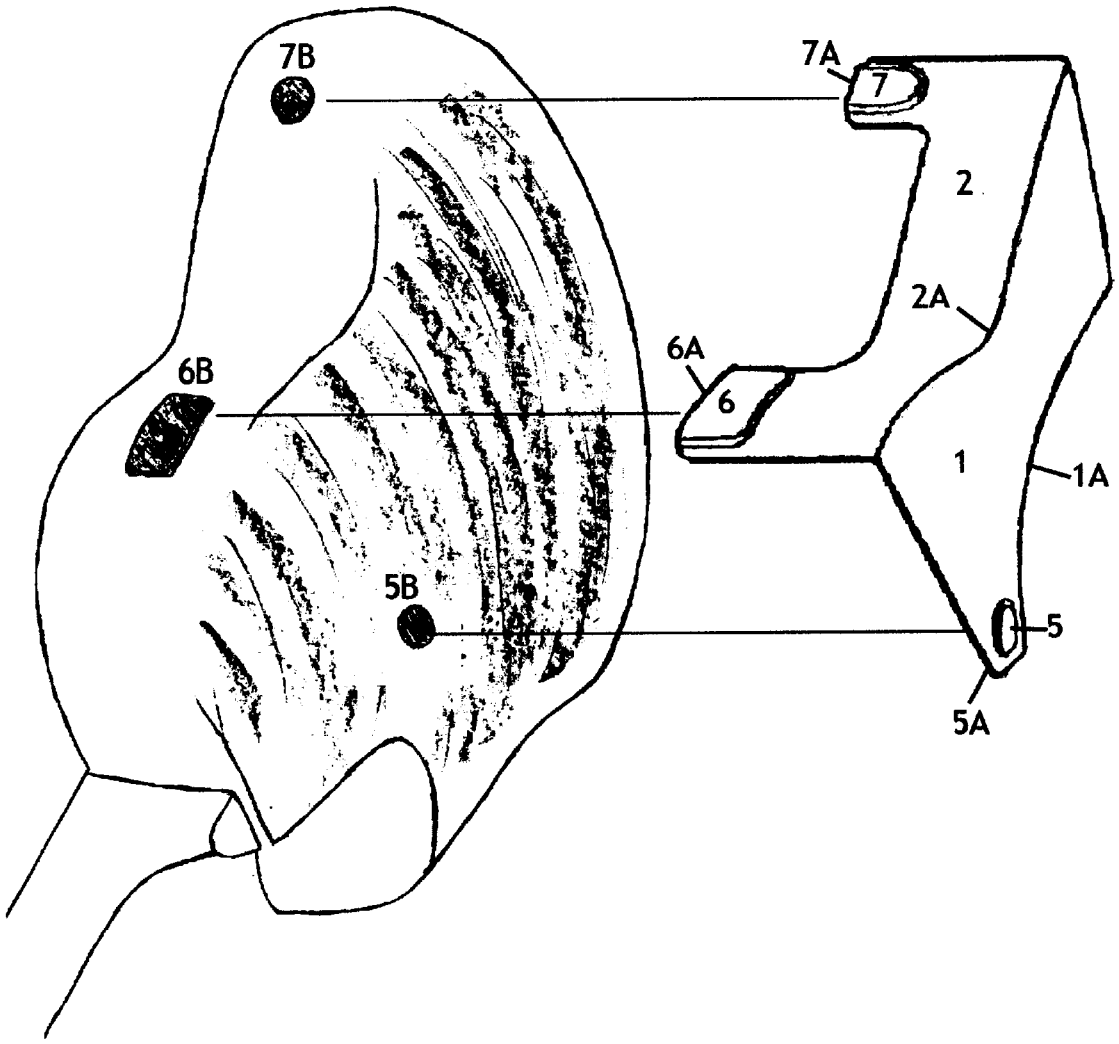
FIG. 2 is a perspective view of the guitar support using Velcro® as flexible adjustable elements of attachment.
Figure 3:
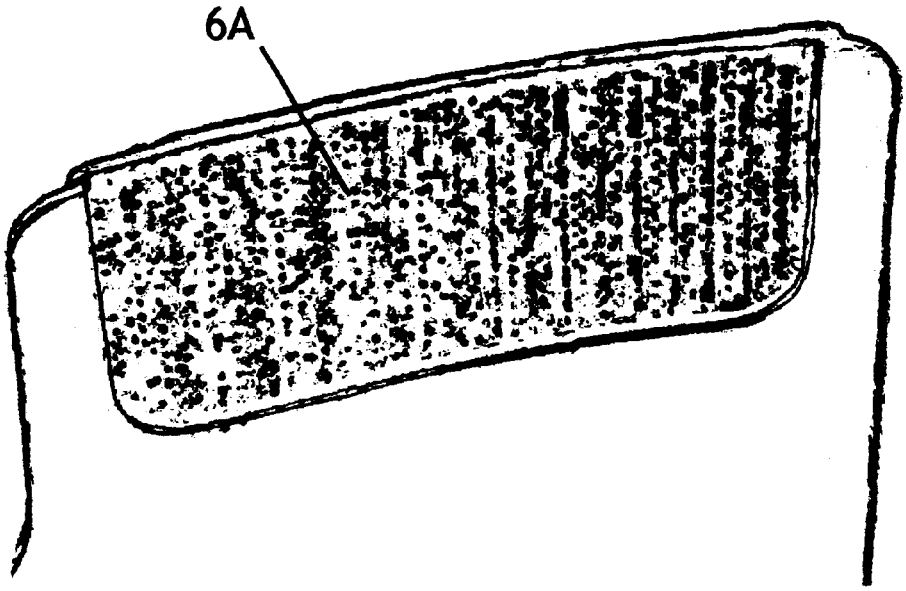
FIG. 3 is a detailed view of the Velcro® patch in the U-shaped protrusion portion of the apparatus.
Figure 4:
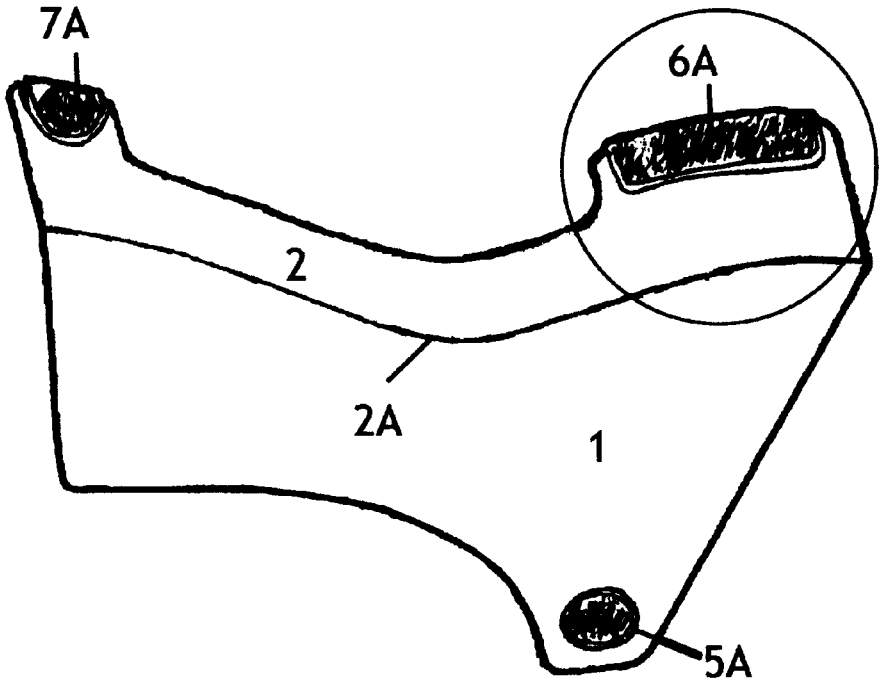
FIG. 4 is a view of the guitar support in a totally flat position.

FIG. 1 illustrates a performer (in this case, a guitarist) A holding a round-backed guitar C with a front surface C1 which round-backed guitar is positioned against his torso by the support for round-backed stringed instrument (the invention) B. The support, B, will be further described with reference to FIG. 2 and FIG. 3 of the drawings. The apparatus, as seen in FIG. 2 of the drawings, consists of a sheet of rigid material, consisting of two parts—surface 1 and surface 2—and a right angle 2A. Edge 1A is configured to match the curve of the round-backed instrument to which the apparatus will attach. The Edge 2A is similarly configured so that Surface 2 comes into contact with the upper edge of the round-backed stringed instrument as held in the standard playing position. The apparatus is attached by means of a plurality of Velcro® patches located in the U-shaped protrusions from the surface—5, 6 and 7—to which are connected detachable fasteners in a preferred embodiment, said fasteners would be single layered Velcro® patches affixed by adhesive to said surfaces 5, 6 and 7, which patches will match their counterpart single layered Velcro®) patches affixed by adhesive to the round-backed instrument—5B, 6B and 7B. FIG. 4 shows surfaces 1 and 2 at right angles to each other, bent along the folds 2A, as well as the recessed Velcro® patches shown in 6A which are detailed in FIG. 3. Operation FIGS. 1, 2—The manner of using the Support B is identical to that for attaching an object by means of detachable fasteners to the back of a stringed instrument in present use. The performer A sits and places the instrument C front surface C1 down across the performer's knees. The performer A grasps the Support B with the performer's right hand and guides the Support B towards the back of the instrument C. The performer A positions the detachable fasteners on the U-shaped protrusion of the Support B 5A, 6A, 7A above the detachable fasteners mounted on the back of the instrument C 5B, 6B, 7B. The performer then brings the pairs of detachable fasteners into contact and applies sufficient pressure to effect a firm connection. The Support B rigidly affixed to the instrument A positions one surface of said support, rigid surface 1, parallel to the front of the stringed instrument. Said surface 1 rests against the torso of the performer A and resists the twisting movement of a round backed stringed instrument during extended rigorous play.

What I claim as my invention is:

1. A round back stringed instrument support comprising:

a folded sheet of rigid material having a generally quadrilateral configuration folded along a curved seam to produce two surfaces at right angles so configured as to permit a plurality of attachment points to said round back stringed instrument; said support further comprising U-shaped protrusions for detachably affixing said support to said stringed instrument; whereby, a first surface of said support is fixed parallel to the front surface of said stringed instrument and a second surface of said support having said U-shaped protrusions is fixed parallel to the side of said stringed instrument.

* * * * *